United States Patent [19]

Matsuo et al.

[11] Patent Number: 4,700,871

[45] Date of Patent: Oct. 20, 1987

[54] LIQUID TRANSFUSING BOTTLE

[75] Inventors: Junichi Matsuo, Yokohama; Kozaburo Sakano, Kawasaki; Isamu Takeda, Tokyo, all of Japan

[73] Assignee: Toyo Seikan Kaisha, Ltd., Tokyo, Japan

[21] Appl. No.: 789,876

[22] Filed: Oct. 21, 1985

[30] Foreign Application Priority Data

Oct. 30, 1984 [JP] Japan ..... 59-164432[U]
Sep. 24, 1985 [JP] Japan ..... 60-145488[U]

[51] Int. Cl.[4] ..... B65D 1/02

[52] U.S. Cl. ..... 222/107; 383/120; 604/408

[58] Field of Search ..... 222/92, 105, 107, 158, 222/206, 209, 215, 94, 95; 604/262, 403, 404, 408, 410, 415; 383/119, 120, 906; 215/DIG. 3, 1 C, 1 R

[56] References Cited

U.S. PATENT DOCUMENTS

| | | | |
|---|---|---|---|
| 3,081,002 | 3/1963 | Tauschinski et al. | 222/107 X |
| 3,325,031 | 6/1967 | Singier | 222/215 X |
| 3,921,630 | 11/1975 | McPhee | 222/107 X |
| 4,088,166 | 5/1978 | Miller | 222/107 X |
| 4,100,953 | 7/1978 | Miller | 222/107 X |
| 4,308,904 | 1/1982 | Martin et al. | 222/107 X |
| 4,553,970 | 11/1985 | Lewis, Jr. | 222/107 X |

FOREIGN PATENT DOCUMENTS

| | | | |
|---|---|---|---|
| 1356549 | 12/1964 | France | 222/107 |

*Primary Examiner*—H. Grant Skaggs
*Assistant Examiner*—Kevin P. Shaver
*Attorney, Agent, or Firm*—Martin A. Farber

[57] ABSTRACT

An improved liquid transfusing bottle made of flexible material of the type using no air venting needle. It includes a barrel portion, a shoulder portion and a bottom portion and parting lines extend on both the side faces in the vertical direction. The barrel portion is formed with ribs or recessed area of which contour line is so designed that a distance as measured from the parting line decreases toward the center part of the bottle from the shoulder portion or the bottom portion. As a residual volume of liquid in the bottle decreases, the barrel portion is deformed in the flattened configuration along the contour lines of the ribs or the recessed parts in such a manner that the shorter diameter thereof is reduced. Deformation of the barrel portion is achieved without any occurrence of twisting, breaking or the like of the bottle and liquid in the bottle is smoothly discharged therefrom at a constant speed during operation of transfusion.

8 Claims, 11 Drawing Figures

LIQUID TRANSFUSING BOTTLE

BACKGROUND OF THE INVENTION

1. Field of the Invention

The present invention relates to a liquid transfusing bottle and more particularly to improvement of or relating to a liquid transfusing bottle made of synthetic resin in which liquid to be transfused such as glucose solution solusion, physiological aqueous solution of salt, Ringer's solution or the like is contained.

2. Description of the Prior Art

A hitherto known liquid transfusing bottle of the above-mentioned type is generally constructed in the form of a glass bottle with a rubber plug fitted thereto. However, due to reduced strength at time when it falls down on the floor or ground and inconvenience of handling of the glass bottle having a heavy weight, the conventional glass bottle is widely replaced with a liquid transfusing bottle (hereinafter referred to simply as a bottle) made of synthetic resin in recent years. It is true that the problems concerning reduced strength at time when the bottle falls down on the floor or ground and reduced dead weight of the bottle have been resolved by employing synthetic resin, but there is still a necessity for using an air venting needle adapted to be pierced through the rubber plug, the bottom wall or the like. As is well known, the air venting needle is intended to prevent the flow of liquid to be transfused (hereinafter referred to simply as liquid) from being stopped under the influence of negative pressure in the bottle which is caused as the liquid is consumed therefrom. But a problem is that dust or like foreign material in the air is introduced into the interior of the bottle together with air as the latter flows through the air venting needle.

As a countermeasure against the problem of introduction of foreign material into the liquid there has been already proposed a so-called closed type bottle (bottle of the type using no air venting needle). In order to inhibit the interior of the proposed bottle of the above-mentioned type from having negative pressure as liquid is consumed therefrom, the bottle is so constructed that the outer wall is flexibly deformed to reduce its diameter in conformance with consumption of liquid and thereby the inside volume of the bottle decreases correspondingly. However, since the conventional bottle is so designed that the outer wall surface of the barrel portion is located flush with the outer surface of the bottom portion and the shoulder portion, elastic deformation is carried out in such a manner that as liquid is consumed, first the barrel portion starts its deformation at the central area thereof to reduce its diameter and both the bottom portion and the shoulder portion are then deform gradually without occurrence of reduction of volume in proportion to consumption of liquid. This leads to such a state that the interior of the bottom is still maintained under the influence of negative pressure, resulting in a comparatively large volume of liquid being left unused in the bottle.

To obviate the foregoing problem there were made proposals, one of them disclosed in U.S. Pat. No. 3,325,031. This proposal is concerned with a bottle made of synthetic resin of the type including a barrel portion having a substantially elliptical crosssectional configuration which is characterized in that at least one of the bottom portion and the shoulder portion has an outer surface which is projected outwardly of the outer surface of both the front and rear sides of the barrel portion, whereby an annular stepped portion adapted to be deformed inwardly is built so as to form a diameter reduction promoting area at the position located in the proximity of both the bottom portion and the shoulder portion.

As a result of the arrangement made in that way it is assured that a residual volume of liquid left unused in the interior of the bottle at the final time of consumption of liquid is reduced remarkably and thereby liquid is consumed effectively.

In spite of the proposal as mentioned above which has a characterizing feature that a residual volume of liquid can be reduced, it has been found that the conventional bottle has still problems of malfunctioning such as distortion of the bottle, breakage of the same or the like in the course of deforming of the bottle in the form of diameter reduction from the starting time of consumption of liquid to the end of the same, resulting in smooth consumption of liquid at a high speed failing to be achieved, and moroever it takes an appreciably long time to discharge liquid.

SUMMARY OF THE INVENTION

Thus, the present invention has been made with the foregoing background in mind and its object resides in providing a flexible liquid transfusing bottle which assures that the bottle is uniformly deformed in the form of a diameter reduction during discharging of liquid to be transfused without any occurrence of malfunction such as distortion, irregular bending, breakage of the bottle or the like.

Another object of the present invention is to provide a liquid transfusing bottle which assures that discharging of liquid is smoothly carried out at a substantially constant speed for a short period of time in such a manner that a ratio of discharging speed is determined more than 75% when the bottle is suspended at a height of 50 cm as measured from the position where measurement is carried out and a ratio of discharging speed is determined more than 85% when it is suspended at a height of 75 cm as measured from the position where measurement is carried out.

To accomplish the above objects there is preposed according to the invention a liquid transfusing bottle made of flexible material of the type including a barrel portion which is constructed in the flattened configuration having a longer diameter and a shorter diameter as seen in the cross-sectional plane, the barrel portion being designed in the substantially symmetrical structure relative to imaginary center lines which extend along the middle part of both the side faces thereof which are located opposite to one another as seen in the direction of the longer diameter, a plurality of deformation guiding parts recessed or projected relative to the side faces being formed on at least a part of the barrel portion located at a predetermined area as seen in the longitudinal direction of the bottle, wherein the improvement consists in that the deformation guiding parts are so contoured that a distance as measured from the imaginary center lines decreases toward the center area of the bottle from the shoulder portion and/or the bottom portion in the longitudinal direction of the bottle.

Other objects, features and advantages of the present invention will become readily apparent from reading of the following description which has been prepared in conjunction with the accompanying drawings.

BRIEF DESCRIPTION OF THE DRAWINGS

The accompanying drawings will be briefly described below.

FIG. 3 (*b*) is a front view of the bottle in FIG. 3 (*a*).

FIG. 4 (*b*) is a front view of the bottle in FIG. 4 (*a*).

DESCRIPTION OF THE PREFERRED EMBODIMENTS

Figure 1:
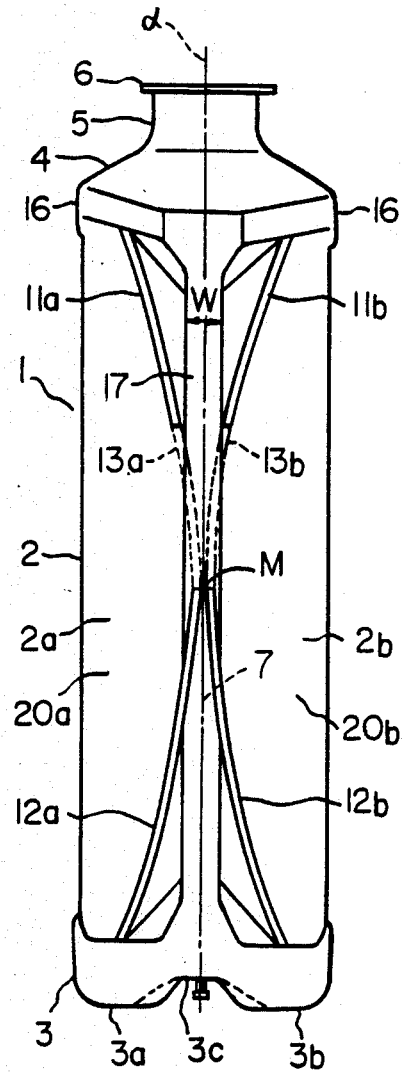
FIG. 1 is a side view of a bottle in accordance with the first embodiment of the invention.

Now, the present invention will be described in a greater detail hereunder with reference to the accompanying drawings which schematically illustrate several preferred embodiments thereof.

First, description will be made as to a liquid transfusing bottle in accordance with the first embodiment of the invention with reference to FIGS. 1 and 2.

In the drawings reference numeral 1 generally represents a liquid transfusing bottle (hereinafter referred to simply as bottle). The bottle 1 is made of transparent or semitransparent flexible material, for instance, polyethylene, polyvinylchloride or the like and comprises a barrel portion 2, a bottom portion 3, a shoulder portion 4, a nozzle portion 5 and an opening 6.

The barrel portion 2 is designed in the flattened geometrical configuration having a longer diameter and a shorter diameter as seen in a cross-sectional plane, for instance, cylindrical configuration shaped in a substantially eliptical cross-sectional contour which is symmetrical both in the vertical direction as well as in the transverse direction. The lower end of the barrel portion 2 is closed with the bottom portion 3, whereas the upper end part of the same is constituted by the shoulder portion 4, the diameter of which as seen in both directions decreases rapidly. The shoulder portion 4 is integrally formed with the nozzle portion 5 having a substantially reduced diameter at the position located above the former and the opening 6 is constituted by the upper end of the nozzle portion 5.

The opening 6 is adapted to tightly receive a plug made of rubber through which a hollow needle is pierced to take the content of the bottle from the interior of the latter.

Parting lines 7 and 8 are located on both side walls of the bottle located opposite to one another as seen in the direction of longer diameter, while extending along an imaginary center line which passes in the center area as defined by each of the side walls whereby they serve as boundary lines for both the front barrel portion 2*a* and the rear barrel portion 2*b*. Further, the bottle 1 includes deformation guiding parts each of which has a contour substantially symmetrical relative to the imaginary center line. In the illustrated embodiment it includes pairs of ribs on both sides of the parting line 7 in such a manner that the latter is interposed therebetween.

Specifically, ribs 11*a* and 12*a* are formed on the surface of the front barrel portion 2*a* located on the one side relative to the parting line 7, whereas ribs 11*b* and 12*b* are formed on the surface of the rear barrel portion 2*b* located on the other side relative to the parting line 7. As is apparent from FIG. 1, the ribs 11*a* and 11*b* as well as the ribs 12*a* and 12*b* are located symmetrical relative to the plane $\alpha$ which extends through the parting lines 7 and 8. The upper ends of the ribs 11*a* and 11*b* are located at the position in the proximity of the shoulder portion 4, whereas the lower ends of the same are oriented downwardly at a certain inclination angle toward the center point M which is located at the middle as seen in the direction of extension of the parting line 7. Thus, both the ribs 11*a* and 11*b* come closer to the parting line 7 as they extend downwardly. On the other hand, the lower ends of the ribs 12*a* and 12*b* are located in the proximity of the bottom portion 3, whereas the upper ends of the same are oriented upwardly at a certain inclination angle toward the center point M. Thus, both the ribs 12*a* and 12*b* come closer to the parting line 7 as they extend upwardly. As will be readily apparent from FIG. 1, there is an area as identified by phantom lines 13*a* and 13*b* where no rib is formed between the lower end of the rib 11*a* and the upper end of the rib 12*a* as well as between the lower end of the rib 11*b* and the upper end of the rib 12*b*. Obviously, a X-shaped figure will be built by connecting a group of lines 11*a*, 13*a* and 12*a* to one another and connecting another group of lines 11*b*, 13*b* and 12*b* to one another and the center at which these lines intersect corresponds to the center point M on the parting line 7.

Similarly, ribs 14*a* and 15*a* are formed on the surface of the front barrel portion 2*a* located on one side relative to the parting line 8. As is apparent from FIG. 2, the ribs 14*a* and 15*a* are located symmetrical to the ribs 11*a* and 12*a* relative to a plane $\beta$ which is defined by the shorter diameter of the transverse plane. Further, additional ribs (not shown) are formed at the position located symmetrical to the ribs 14*a* and 15*a* relative to the plane $\alpha$ on the surface of the rear barrel portion 2*b* on the other side of the parting line 8.

It should be noted that all the ribs are designed in a shallow groove-shaped configuration as seen in the cross-sectional plane.

As is apparent from the drawing, the junction portion 16 as defined between the upper part of the barrel portion 2 and the shoulder portion 4 is designed to have a diameter appreciably larger than that of the barrel portion 2 with the exception of the area located in the vicinity of the parting lines 7 and 8.

A diameter of the bottom portion 3 is determined appreciably larger than that of the lower end of the barrel portion 2 with the exception of the area located in the vicinity of the parting lines 7 and 8.

The lowermost surface of the bottom portion 3 has a recessed part 3*c* extending along the larger diameter which is raised upwardly toward the barrel portion 2 as seen in the drawing. Thus, parts 3*a* and 3*b* located on both sides of the part 3*c* serve as standing feet.

The barrel portion 2 has flat planes 17 having a predetermined width W extending in parallel with the parting lines 7 and 8 which are located at the center thereof with the exception of the area where they intersect the ribs.

Figure 3A:
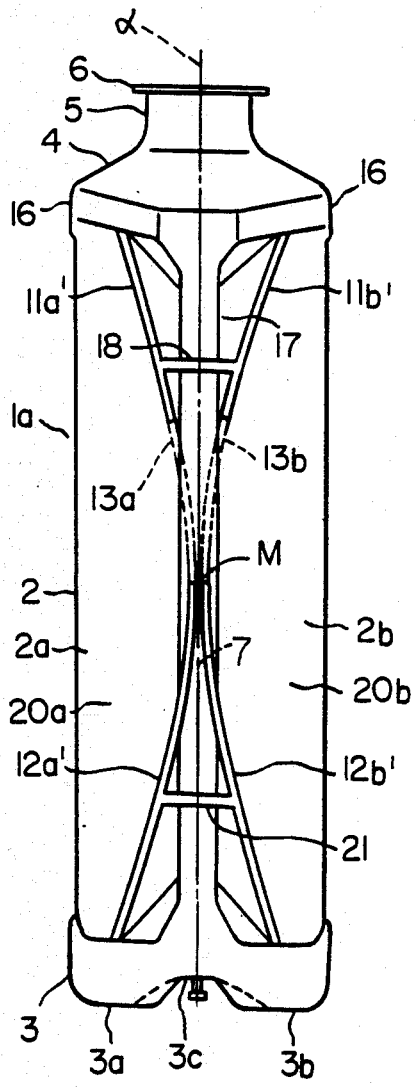
FIG. 3 (*a*) is a side view of a bottle in accordance with a modified embodiment of the invention.
Figure 3B:
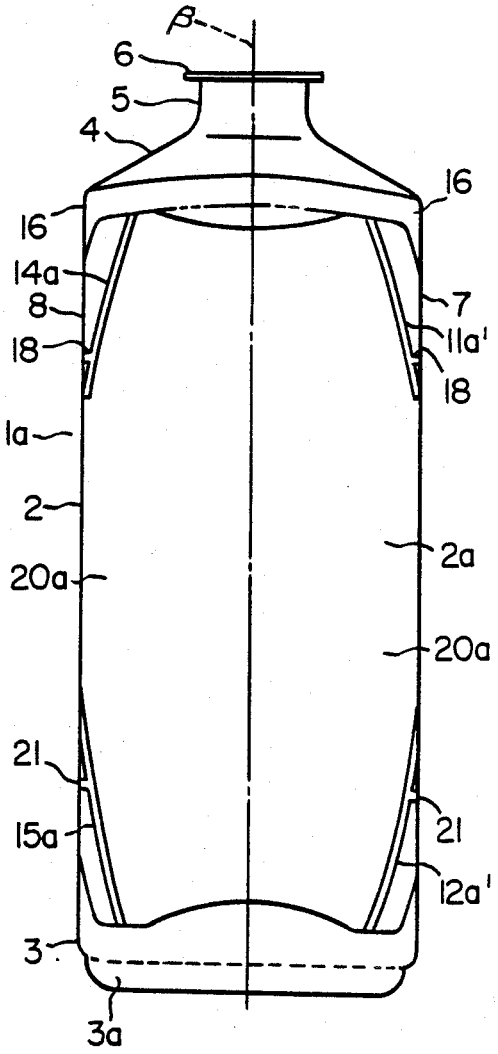
Figure 4A:
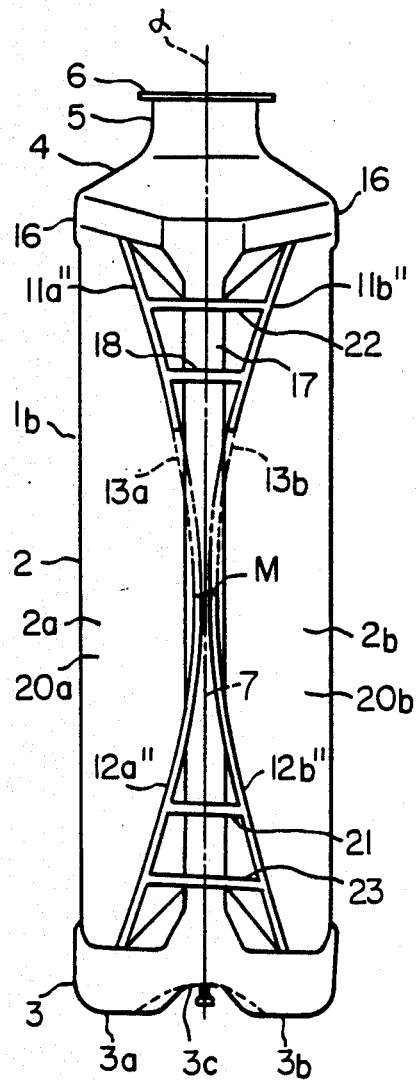
FIG. 4 (*a*) is a side view of a bottle in accordance with another modified embodiment of the invention.
Figure 4B:
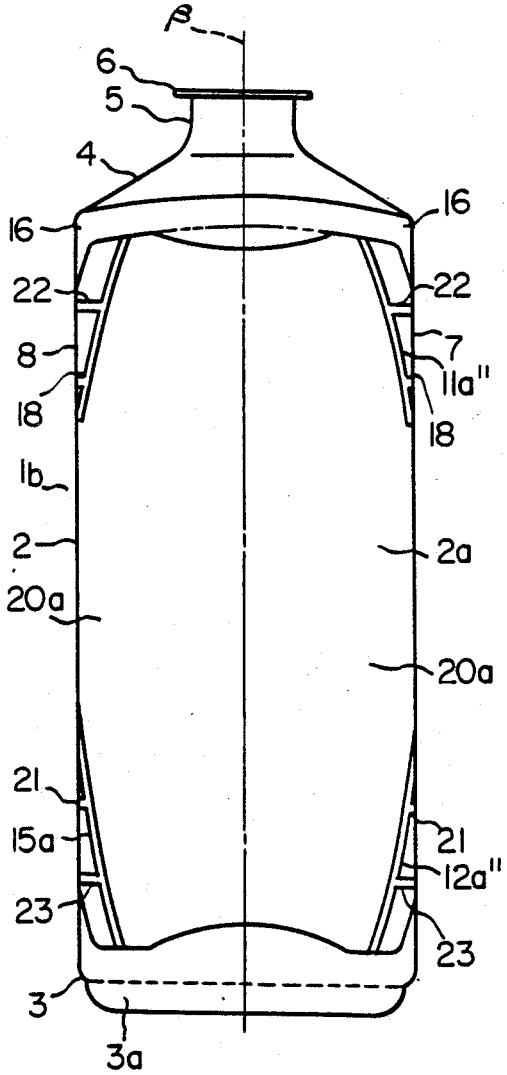

It should of course be understood that the present invention should not be limited only to the ribs having the contour as mentioned above. Alternatively, the bottle 1*a* may be so modified that a horizontal rib 18 is bridged between both the ribs 11*a'* and 11*b'* and another horizontal rib 21 is bridged between both the ribs 12*a'* and 12*b'*, as shown in FIGS. 3(*a*) and (*b*). Further, the bottle 1*b* may be so modified that an additional horizontal rib 22 extends in parallel with the horizontal rib 18 in the area as defined between both the ribs 11*a''* and 11*b''* and another additional horizontal rib 23 extends in parallel with the horizontal rib 21 in the area as defined between both the ribs 12*a''* and 12*b''*, as shown in FIGS. 4(*a*) and (*b*).

Figure 2:
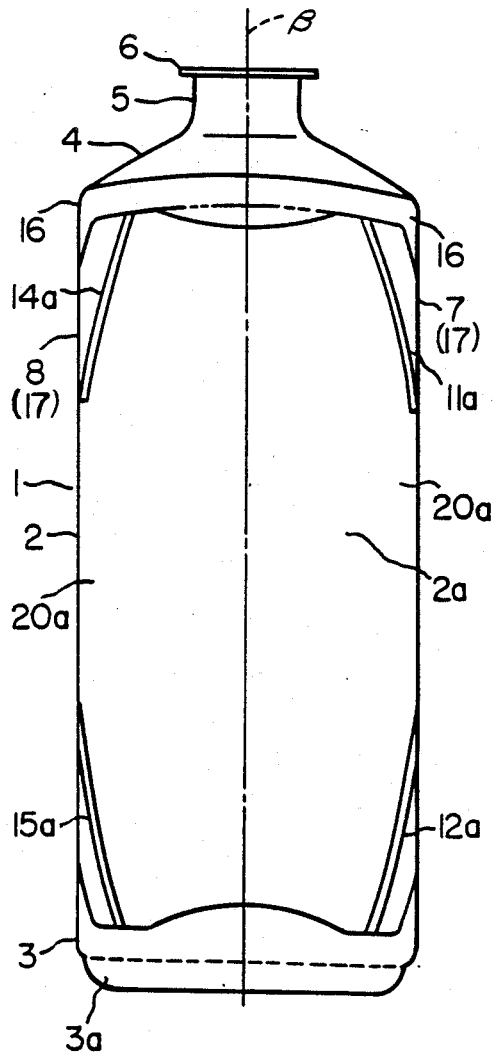
FIG. 2 is a front view of the bottle in FIG. 1.

The same parts as in FIGS. 1 and 2 have the same reference characters in the other figures and specific description not being repeated.

In the above-described embodiments all the ribs are in a groove-shaped configuration, that is, concave configuration, as seen in the cross-sectional plane. However, the present invention should not be limited only to this. Alternatively, they may be designed in a projection-shaped configuration, that is, convex configuration as seen in the cross-sectional plane.

Next, utilization of the bottle of the invention will be described below.

First, the bottle 1 is filled with liquid to be transfused and a plug made of rubber or the like material is then air-tightly fitted to the opening of the bottle. Thereafter, a hollow needle is pierced through the thus air-tightly fitted plug whereby communication is established between the interior of the bottle and the outside of the latter. Now, liquid in the bottle is ready to be discharged therefrom through the hollow needle while it is supported in the upside-down state.

As liquid is discharged from the bottle 1, the effective inside volume of the latter decreases, causing the walls of the bottle to be deformed inwardly. However, the areas surrounded by the ribs 11*a*, 11*b*, 12*a* and 12*b* in the vicinity of the parting lines 7 and 8 are difficult to be deformed. Similarly, the area extending from the junction portion 16 to the opening 6 as well as the bottom portion 3 are difficult to be deformed. Thus, deformation is developed in areas 20*a* and 20*b* on the barrel portion 2 located outside the X-shaped contour of the ribs. It should be noted that deformation occurs along the ribs. Since the areas 20*a* and 20*b* have a wide surface area, discharging of liquid is smoothly carried out at a high speed as they deform inwardly, without any occurrence of malfunction such as distortion of the bottle, breakage of the same or the like. Subsequently, deformation is gradually carried out in such a manner that the central areas of the areas 20*a* and 20*b* come closer to one another. As they come close to one another increasingly, the bottom portion 3 is caused to bend about the recessed part 3*c* which extends along the longer diameter thereof whereby both the parts 3*a* and 3*b* located on both the sides of the recessed part 3*c* come closer to one another. This allows both the portions 20*a* and 20*b* to come to one another sufficiently. At the same time the shoulder portion 4 is deformed to a flattened configuration in conformance with deformation of the barrel portion 2 along the ribs, resulting in substantially entire volume of liquid being discharged from the bottle. This means that discharging of liquid is achieved at a predetermined high speed for a short period of time.

Since the bottle of the invention has flat planes 17 having a predetermined width W with the parting lines 7 and 8 located at the middle of the latter on both the sides thereof, they serve as contact surfaces relative to the adjacent bottle when a number of bottles are transported by means of a belt conveyor or the like. Thus, transportation is successfully carried out with minimized occurrence of deviation of some bottle from the conveyor line. Further, it is possible to visually inspect granular material contained in the bottle through the transparent areas 13*a* and 13*b* as identified by phantom lines where no rib is formed.

EXAMPLES OF EXPERIMENTS

A ratio of discharging speed as represented by (discharging speed ÷ initial discharging speed × 100) was measured with respect to samples of bottles bottle of the invention as well as conventional ones. The results of measurements are as shown in FIGS. 5 and 6.

Figure 5:
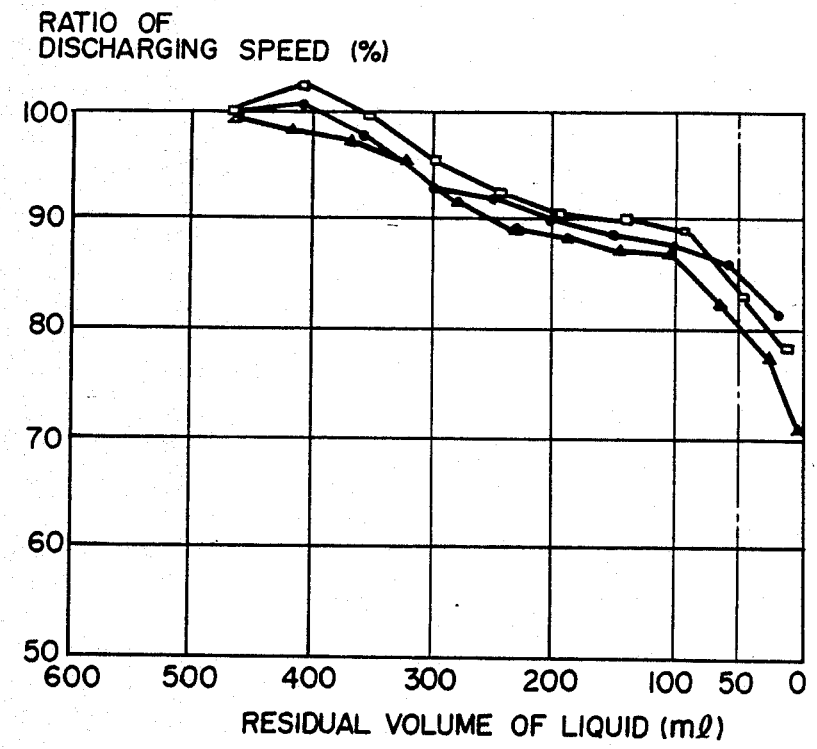
FIG. 5 is a graph representing a relation of residual volume of liquid vs. ratio of discharging speed with respect to the bottle as shown in FIGS. 1 and 2.
Figure 6:
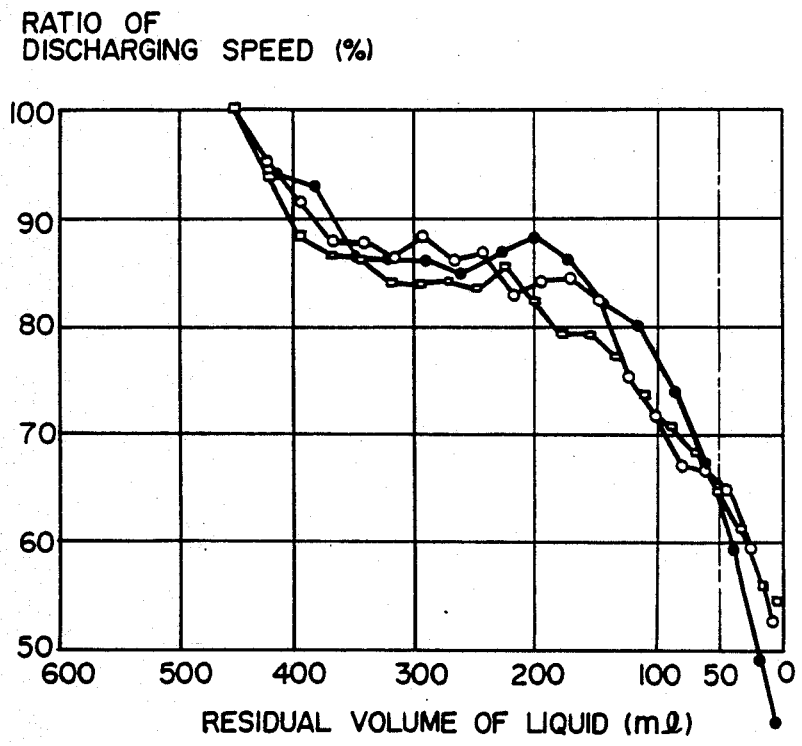
FIG. 6 is a graph similar to that in FIG. 5 representing a relation of residual volume of liquid vs. ratio of discharging speed with respect to a conventional bottle with no rib formed thereon which is designed to have the same dimensions as those of the bottle in FIGS. 1 and 2.

Specifically, FIGS. 5 and 6 graphically illustrate a number of measured ratios of discharging speed with respect to three samples of bottles bottle with ribs formed thereon in accordance with the first embodiment of the invention as shown in FIGS. 1 and 2 as well as three samples of conventional bottles bottle with no rib formed thereon.

The experiment conditions in FIG. 5 are noted below.

RETORT: existent,
BOTTLE: ISB-500BSY 8X,
material filled in bottle: water,
needle used therefor: JMS-200,
height of discharging: 75 cm.

The experiment conditions in FIG. 6 are noted below.

RETORT: existent,
BOTTLE: ISB-500BS,
material filled in bottle: water,
needle used therefor: JMS-200,
height of discharging: 75 cm.

As will be readily apparent from a comparison of FIG. 5 with FIG. 6, there is a remarkable difference therebetween. Specifically, as far as a bottle having a capacity of 475cc is concerned, it is found that the bottle of the invention has a ratio of discharging speed higher than that of the conventional one from the time point when a residual volume of liquid amounts to about 300cc. The bottle of the invention has a ratio of discharging speed of about 75% at the time point when a residual volume of liquid amounts to 50cc while the conventional one has a ratio of discharging speed of about 60% at the same time point, and the bottle of the invention has a ratio of discharging speed of about 70% at the time point when a residual amount of liquid amounts to about zero while the the conventional one has a ratio of discharging speed of about 50% at the same time point. This shows characterizing features of the present invention that the bottle of the invention has an excellent high capability of liquid discharge and thereby liquid can be discharged at a constant high speed for a short of time during the entire operation of transfusion.

Next, description will be made as to a bottle in accordance with the second embodiment of the invention. This second embodiment is different from the first embodiment in respect of the fact that the deformation guiding parts are formed in symmetrical relation relative to the imaginary center line on the side wall of the bottle in the form of recessed parts 11 and 13 which are located in substantially the same area as in the foregoing embodiment.

Figure 7:
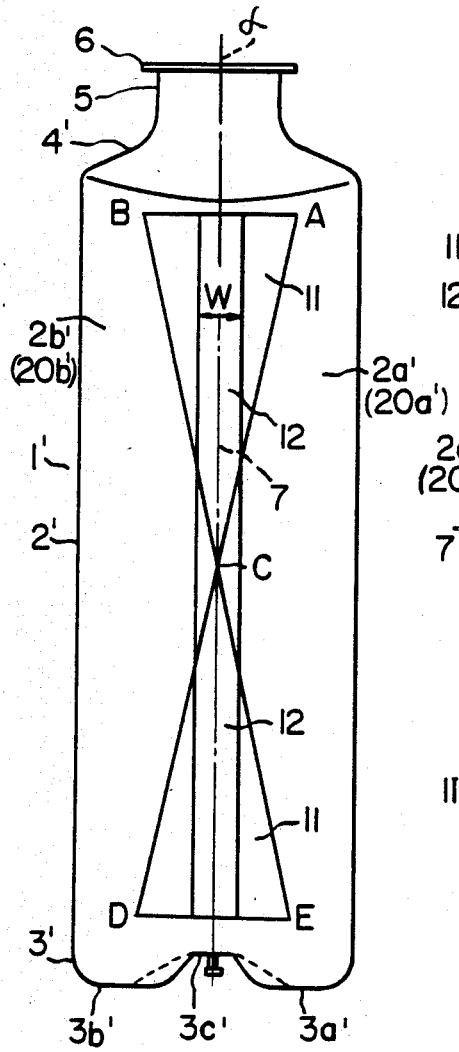
FIG. 7 is a side view of a bottle in accordance with the second embodiment of the invention.
Figure 8:
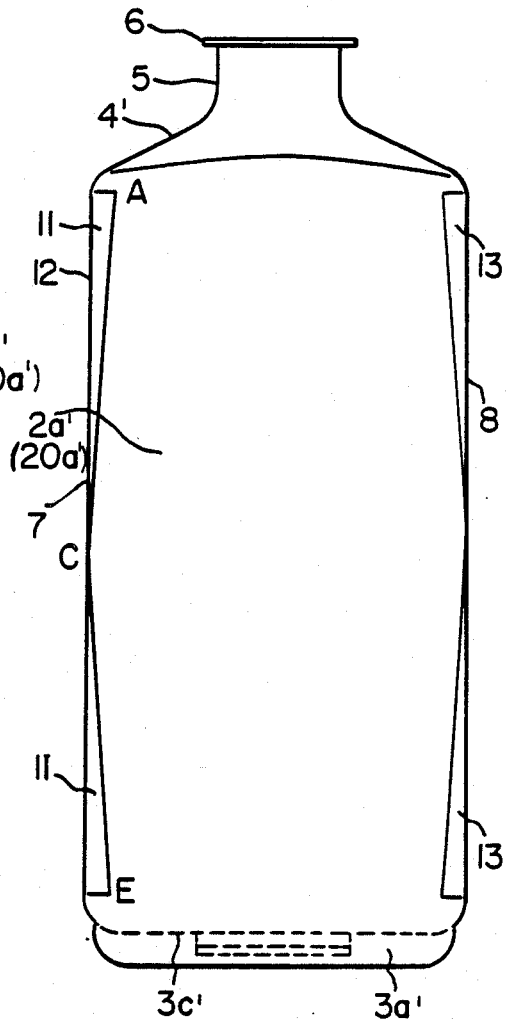
FIG. 8 is a front view of the bottle in FIG. 7.

Now, the second embodiment of the invention will be described below with reference to FIGS. 7 and 8.

As is apparent from the drawings, parting lines 7 and 8 extend in the vertical direction at the middle of both the side walls of the barrel portion 2' of the bottle 1' which are located opposite to one another in the direction of longer diameter and they serve as a boundary between the front barrel portion 2a' and the rear barrel portion 2b'. The recessed parts 11 as defined by points A, B, C, D, E and C in the polygonal contour are formed on both sides of the parting line 7 in symmetrical relation relative to the latter as seen in FIG. 7.

As a whole the side walls of the bottle 1 are designed in slightly curved configuration and therefore the area as defined by the points A, B, C, D, E and C is a three dimentional symmetrical figure relative to the plane $\alpha$ which extends through the parting lines 7 and 8. Thus, they are recognized as polygonal figures when they are seen from the side. The polygonal figure as defined by the points A, B, C, D, E and C is constituted by two isosceles triangles ABC and DEC which are connected to one another at the point C in an X-shaped pattern while their bottom lines are connected at the same point to form a single straight line.

The points A and B are located just below the shoulder portion 4', the points D and E are located just above the bottom portion 3' and the point C is located at the middle of the parting line 7 as seen in the vertical direction. Thus, the contour of the recessed parts is designed in such a manner that the distance as measured from the shoulder portion downwardly as well as the distance as measured from the bottom portion upwardly decrease gradually as the measured position is located away from the parting line 7.

The depth of the recessed parts 11 is determined, for instance, about 1 mm in the case of a bottle 1' which has a capacity of 820 ml (as measured at the time when overflowing takes place).

Each of the recessed parts 11 is lowered from the other part but its surface does not exhibit an uniform curved plane. A part of the recessed area 11 as identified by reference numeral 12 which is flush with the band-shaped area having a width W with the parting line 7 located at the middle thereof forms a flat plane. Thus, the area 12 serves as a contact surface at which the adjacent bottles come in contact when they are transported by means of a belt conveyor or the like. Thus, transportation is carried out without any occurrence of deviation of some bottles away from the conveyor line during operation of transportation.

Similarly, recessed parts 13 are formed on both the sides of the parting line 8 in the same manner as in the foregoing case.

A part 3c' extending along the longer diameter on the lowermost surface of the bottom portion 3' is recessed upwardly toward the center of the bottle and parts 3a' and 3b' located on both the sides of the part 3c' serve as standing feet.

Next, utilization of the bottle of the invention will be described below.

First, the bottle 1' as constructed in the abovedescribed manner is filled with liquid to be transfused and a plug made of rubber or the like material is then airtightly fitted to the opening of the bottle. Thereafter, a hollow needle is pierced through the thus airtightly fitted plug whereby communication is established between the interior of the bottle and the outside of the same. Now, liquid in the bottle is ready to be discharged therefrom through the hollow needle while it is suspended from above in the upside-down state.

As liquid is discharged from the bottle 1', the effective volume of the latter decreases, causing the walls of the bottle to be deformed inwardly. It should be noted that deformation is initiated with the aid of the X-shaped contour lines of the recessed parts 11 and 13 located in the vicinity of the parting lines in such a manner that the areas located outside the X-shaped contour lines, that is, the center areas 20a' and 20b' of the front barrel portion 2a' and the rear barrel portion 2b' are deformed inwardly.

Since the center area 20a' and 20b' have a wide surface area, inward deformation is carried out without any occurrence of malfunction such as distortion of the bottle, breakage of the same of the like. Thus, liquid is smoothly discharged at a high speed and thereby the center parts of the areas 20a' and 20b' are gradually deformed to the flattened configuration in such a manner that they come closer to one another.

As they come close to one another increasingly, the bottom portion 3' bends about the recessed part 3c' which extends along the longer diameter thereof whereby both the parts 3a' and 3b' located on both the sides of the recessed part 3c' come closer to one another. This allows both the areas 20a' and 20b' to come close to one another sufficiently. At the same time the shoulder portion 4' is deformed to the flattened configuration in conformance with deformation of the recessed parts of the barrel portion, resulting in substantially the entire volume of liquid in the bottle being discharged therefrom. This means that the discharging of liquid is achieved at a predetermined high speed for a short period of time.

The boundary between the recessed parts 11 and 13 and the areas 20a' and 20b' are subjected to bending two times with a distance of about 1 mm held between both the ends thereof. On the other hand, each rib constituting a boundary is subjected to bending four times in the foregoing embodiment. Thus, deformation of the bottle of the invention is carried out against a reduced intensity of resistance, compared with the foregoing embodiment. Accordingly, both the shoulder portion and the bottom portion are smoothly deformed in conformance of deformation with the barrel portion to the flattened configuration whereby substantially the entire volume of liquid is discharged from the bottle for a shorter period of time than the first embodiment without fluctuation of the speed of discharging.

EXAMPLE OF EXPERIMENTS

Figure 9:
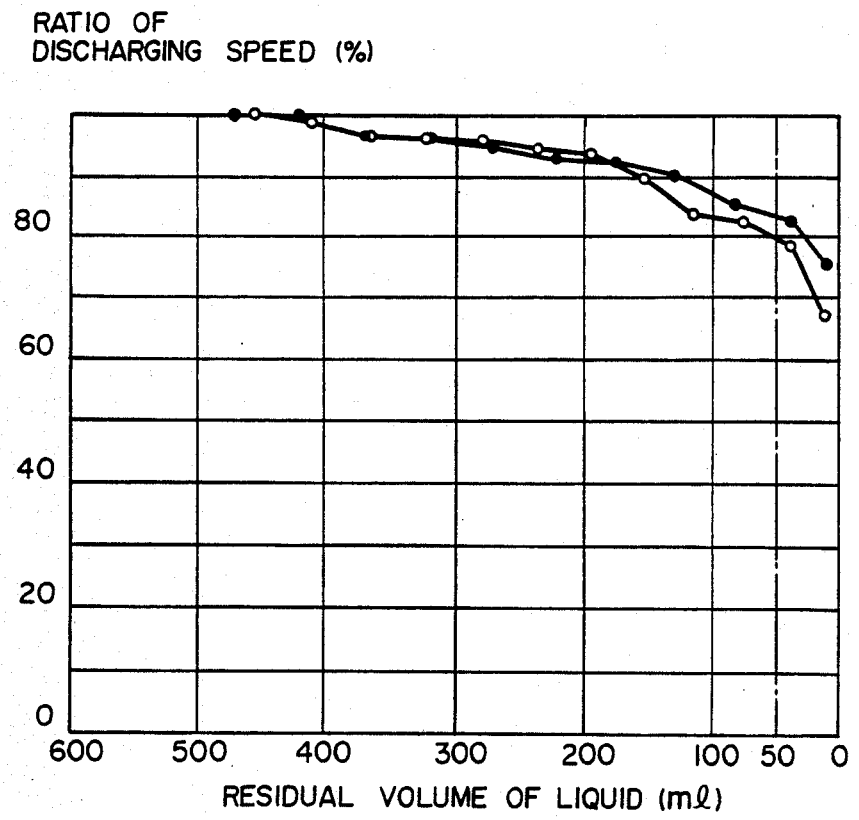
FIG. 9 is a graph representing a relation of residual volume of liquid vs. ratio of discharging speed with respect to the bottle as shown in FIGS. 7 and 8.

A ratio of discharging speed as represented by (discharging speed ÷ initial discharging speed × 100) was measured with respect to samples of the bottle in accordance with the second embodiment of the invention and graphs as shown in FIG. 9 were obtained as a result of measurements.

Specifically, FIG. 9 shows graphs representing a ratio of discharging speed measured with respect to two samples of the bottle in accordance with the second embodiment of the invention in which water is filled as the transfusion liquid, wherein each of the samples is designed to have the same dimensions and configuration as those of the bottles in accordance with the first embodiment of the invention (by means of which the graphs in FIG. 5 were prepared).

The experiment conditions in FIG. 9 are noted below.

RETORT: existent,
BOTTLE: ISB-500BSY 8X,
material filled in the bottle: water,
needle used therefor: JMS-200,
height of discharging: 75 cm.

As will be readily apparent from a comparison of FIG. 9 with FIG. 5, there is a remarkable difference therebetween. Specifically, with respect to the bottle as shown in FIG. 5 which has a capacity of 475cc it is found that a ratio of discharging speed instantaneously exceeds 100% in the area where a residual volume of liquid amounts to 475cc to 150cc and it decreases below 90% in the area where a residual volume of liquid amounts to about 200cc. This means that the bottle in FIG. 5 has some fluctuation of discharging speed. On the contrary, the bottle in FIG. 9 has a substantially constant ratio of discharging speed in the range of 95 to 100%. Further, it is found that the ratio decreases smoothly at an uniform rate with fluctuation of discharging speed being hardly recognized. Even in the area where a residual volume of liquid is less than 150 cc it is confirmed that discharging speed decreases smoothly and as a whole liquid is discharged at a substantially constant speed for a short period of time.

While the present invention has been described above with respect to a few preferred embodiments thereof, it should of course be understood that it should not be limited only to them but various changes or modifications may be made in any acceptable manner without departure from the spirit and scope of the invention.

What is claimed is:

1. In a liquid transfusing bottle made of flexible material including a barrel portion, and a shoulder portion at a top of said barrel portion and a bottom portion at a lower end of said barrel portion, said barrel portion having a flattened configuration having a front barrel portion and a rear barrel portion which are located opposite to one another in a direction of a shorter diameter with respect to a cross-sectional plane of the bottle, and side walls which are located opposite to one another in a direction of a longer diameter with respect to said cross-sectional plane and comprise sides of said front barrel portion and said rear barrel portion, said barrel portion being deformable and having a substantially symmetrical structure relative to an imaginary plane in which an imaginary parting line respectively extends along a middle part of both of the side walls in a longitudinal direction thereof, and deformation guiding parts formed relative to the side walls at a predetermined area with respect to the longitudinal direction of the bottle, the improvement wherein each of said side walls defines a substantially flat side extending from the shoulder portion to the bottom portion, and said side walls are parallel to each other, said front and rear barrel portions ending at said flat sides, said deformation guiding parts being cross-shaped, extending from adjacent said shoulder portion and said bottom portion partly in said front and rear barrel portions, crossing into the flat sides, said deformation guiding parts each defining an edge such that a distance from said parting line at a corresponding side wall to the edge of a corresponding deformation guiding part decreases continuously approaching substantially a center of the corresponding side wall from substantially adjacent the shoulder portion and from substantially adjacent the bottom portion in the longitudinal direction of the bottle and in symmetrical relation relative to said parting line.

2. The liquid transfusing bottle according to claim 1, wherein said flexible material is selected from the group consisting of polypropylene, polyethylene and polyvinylchloride.

3. The liquid transfusing bottle according to claim 1, wherein said flexible material is transparent.

4. The liquid transfusing bottle according to claim 1, wherein said flexible material is semitransparent.

5. The liquid transfusing bottle according to claim 1, wherein said side walls are slightly curved.

6. The liquid transfusing bottle according to claim 1, wherein said deformation guiding parts by said edges define recessed portions of said front barrel portion and said rear barrel portion and the corresponding side wall, each of said recessed portions defines a polygon forming two isosceles triangles joined at a common apex at said center forming an X-shaped pattern.

7. In a liquid transfusing bottle made of flexible material including a barrel portion, and a shoulder portion at a top of said barrel portion and a bottom portion at a lower end of said barrel portion, said barrel portion having a flattened configuration having a front barrel portion and a rear barrel portion which are located opposite to one another in a direction of a shorter diameter with respect to a cross-sectional plane of the bottle, and side walls which are located opposite to one another in a direction of a longer diameter with respect to said cross-sectional plane and comprise sides of said front barrel portion and said rear barrel portion, said barrel portion being deformable and having a substantially symmetrical structure relative to an imaginary plane in which a parting line respectively extends along a middle part of both of the side walls in a longitudinal direction thereof, and deformation guiding parts being formed relative to the side walls at a predetermined area with respect to the longitudinal direction of the bottle, the improvement wherein each of said side walls defines a substantially flat side extending from the shoulder portion to the bottom portion, and said side walls are parallel to each other, said front and rear barrel portions ending at said flat sides, said deformation guiding parts being cross-shaped, extending from adjacent said shoulder portion and said bottom portion partly in said front and rear barrel portions, crossing into the flat sides, said deformation guiding parts are ribs adjacent the side walls defining an edge such that a distance from said parting line at a corresponding side wall to the edge of a corresponding deformation guiding part decreases approaching substantially a center of the corresponding side wall from substantially adjacent the shoulder portion and from substantially adjacent the bottom portion in the longitudinal direction of the bottle and in symmetrical relation relative to said parting line.

8. The liquid transfusing bottle according to claim 7, further comprising horizontal ribs connecting said ribs at one side between the front and rear barrel portions.

* * * * *